United States Patent [19]

Wenzel

[11] Patent Number: 4,906,004

[45] Date of Patent: Mar. 6, 1990

[54] RANDOM NUMBER SELECTOR

[76] Inventor: Anton Wenzel, 4001 North St. Joseph Ave., Evansville, Ind. 47712

[21] Appl. No.: 295,227

[22] Filed: Jan. 9, 1989

[51] Int. Cl.[4] ..... A63F 9/00

[52] U.S. Cl. ..... 273/138 R; 273/144 B

[58] Field of Search ..... 273/138 R, 144 R, 144 A, 273/144 B

[56] References Cited

U.S. PATENT DOCUMENTS

| | | | |
|---|---|---|---|
| 1,486,690 | 3/1924 | Scheliga | 273/144 A X |
| 1,562,197 | 11/1925 | Andrew | 273/144 A |
| 3,166,323 | 1/1965 | Anderson | 273/144 B X |
| 3,770,272 | 11/1973 | Olivier | 273/144 R X |

*Primary Examiner*—Anton O. Oechsle

*Attorney, Agent, or Firm*—Warren D. Flackbert

[57] ABSTRACT

A random number selector whereby a series of pellets are moved from a collected condition to a series of peripherally arranged recesses. The selector basically includes a body overlaid by a spaced apart cover, where the latter presents, in the apex region thereof, a pellet receiving cavity representing a storage condition prior to any intended pellet distribution after passage to a distribution core. Distribution is readily accomplished by selector placement on a receiving surface, creating movement of the collected pellets upwardly, then in a downward direction along a portion of the body, and finally into one of a series of numbered recesses.

6 Claims, 1 Drawing Sheet

RANDOM NUMBER SELECTOR

As is known, the selection of random numbers, as used by players in a State lottery, is of increasing interest in that number choice based on, for example, dates of personal happenings or the like oftentimes diminish. As a result, the need for a mechanical approach in the selection of a plurality of numbers has become desirable, and it is such need that the invention serves to satisfy.

BRIEF DESCRIPTION OF THE INVENTION

More specifically, the invention presents a random number selector utilizing the distribution of metal pellets from a centrally disposed distribution core, where, with the placement of the selector on a receiving surface, the pellets move upwardly, outwardly and downwardly into peripherally arranged recesses bearing identification numerals. Restated otherwise, the aforesaid pellet distribution core is created by a spring-biased plunger, where movement of the pellets from the aforesaid core is by reason of plunger movement against the force of the spring.

The pellets are contained within a fixed cover overlying the body of the selector, where the cover includes a centrally disposed upwardly extending cavity which serves to receive pellets after the selector is inverted, i.e. when the pellets move from the recesses along the inner surface of the cover and to the cavity. Then, upon the return of the selector to the initial position (again by inverting), the pellets fall, by gravity, into the distribution core described above. It should be evident, therefore, that the random number selector presented herein is simple in form and in use.

DESCRIPTION OF THE FIGURES

In any event, a better understanding of the present invention will become more apparent from the following description, taken in conjunction with the accompanying drawing, wherein.

Figure 1:
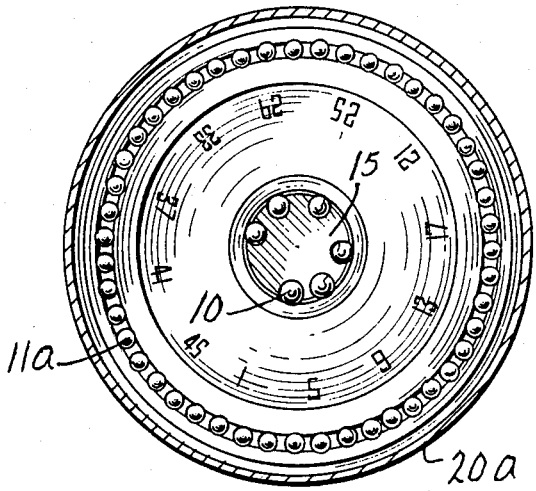
FIG. 1 is a view in horizontal section, taken at line 1—1 on FIG. 3 and looking in the direction of the arrows, showing a random number selector in accordance with the teachings of the present invention.
Figure 2:
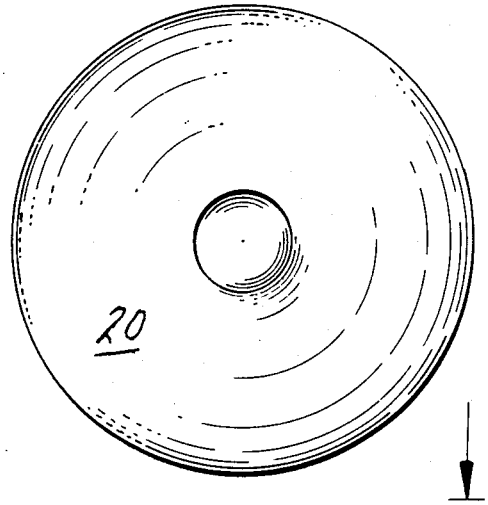
FIG. 2 is a top plan view of the instant selector.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the instant random number selector is defined by a body 11, typically circular in plan view and including pellet selector recesses 11*a* around the periphery thereof. The pellet receiving recesses 11*a* are, typically, numbered, so that when a pellet or pellets 10 are ultimately positioned, a selection of numbers is made available to the user. In this connection and by way of example, with six pellets 10, a combination of 12-14-23-25-27-37 may be presented. Such numbers may, thereafter, be used as desired.

The body 11 includes a centrally disposed opening 11*b* having an enlarged upper portion 11*b'* and an enlarged lower portion 11*b''*. The opening 11*b* is adapted to receive the stem 12*a* of a control plunger 12, where members 12*a'* and 12*a''* define opposite ends of the stem 12*a*. As should be apparent in FIG. 3, a resilient member or spring 14 encircles a portion of the stem 12*a* and is seated between a horizontal wall 11*c* in body 11 and end member 12*a''*, serving to continually urge control plunger 12 into a position presenting a pellet distribution core 15. The latter is defined by the top surface of end member 12*a'* and an associated chamfered lip 11*d* formed on body 11 (again see FIG. 3).

The assembly is completed by a cover 20, typically positioned by an adhesive. The cover 20, as disclosed in FIGS. 3 and 4, includes an inwardly and upwardly extending wall 20*a*, terminating in an extended pellet receiving cavity 20*b* at the central or apex region thereof. It might be noted that, with the exception of spring 14, all components are formed from a durable plastic resin.

In a use condition, and assuming that the pellets 10 have already been scattered into receiving recesses 11*a*, the selector is inverted, meaning that the pellets 10 leave the pellet receiving cavities 11*a*, slide along the inner surface of wall 20*a*, and assemble or collect in the receiving cavity 20*b* at the apex of the selector. It should be noted at this time that the pellet distribution core 15 is depressed due to the force of spring 14 bearing against member end 12*a''* of the plunger 12.

Figure 3:
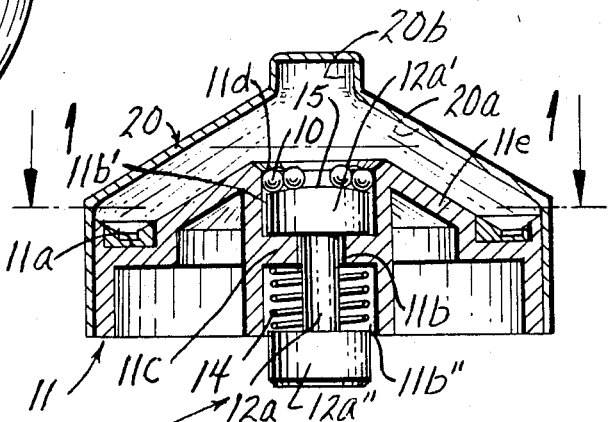
FIG. 3 is a view in vertical section typically showing the pellets of the selector after collection but before distribution; and, FIG. 4 is another view in vertical section illustrating pellet movement after a control plunger evacuates the central pellet distribution core.
Figure 4:
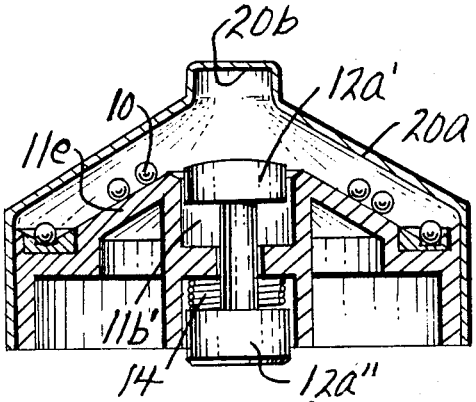

The selector is then again inverted, meaning that the pellets 10 fall downwardly, by gravity, into the pellet distribution core 15 (as shown in FIG. 3). Thereafter, the selector is placed on a supporting surface, for example, causing the plunger 12 to move toward the cover 20 and scattering the pellets 10 from the pellet distribution core 15. At this time, each of the pellets 10 moves downwardly along an inclined inner wall 11*e* of the body 11 to one of the pellet receiving recesses 11*a* Random number selection has now been achieved, and the preceding operation is repeated when and as necessary.

As should be evident, the selector presented herein is light in weight; hand held; representative of positive pellet accumulation after selector inversion and prior to new number selection; and, through action against the normally biased plunger, effects distribution of pellets into recesses numbered to accommodate identification needs.

The random number selector described above is susceptible to various changes within the spirit of the present invention, including, by way of example, in proportioning; the movement of the plunger by finger movement instead of by selector placement; material choice; and, the like. Thus, the preceding should be considered illustrative and not as limiting the scope of the following claims:

I claim:

1. A number selector comprising a body overlaid by a cover and a plurality of pellets, said body having a centrally disposed opening terminated by enlarged upper and lower portions and a downwardly inclined inner wall extending from said enlarged upper portion and terminated by a plurality of peripherally arranged pellet receiving recesses, a plunger disposed within said opening and including ends operable within respective ones of said enlarged portions, and resilient means biasing said plunger in a direction away from the top of said cover, the upper surface of the upper end of said plunger cooperating with a portion of said enlarged upper portion to define a pellet distribution core prior to movement of said plunger upwardly to a pellet distributing position to scatter the pellets onto said inner wall.

2. The number selector of claim 1 where placement of said selector on a receiving surface serves to move said plunger in the direction of said top of said cover.

3. The number selector of claim 1 where said cover includes an inwardly and upwardly extending wall terminating in a pellet receiving cavity at the mid-region thereof.

4. The number selector of claim 3 where inversion of said body achieves movement of said pellets from said receiving recesses to said pellet receiving cavity.

5. The number selector of claim 3 where further inversion of said body causes the dropping of said pellets from said pellet receiving cavity to said pellet distribution core.

6. The number selector of claim 1 where said downwardly inclined wall of said body provides a pellet movement path from said pellet distribution core to said peripherally arranged pellet receiving recesses.

* * * * *